US009986348B2

(12) United States Patent
Sø et al.

(10) Patent No.: US 9,986,348 B2
(45) **Date of Patent: *May 29, 2018**

(54) ANTENNA UNIT

(71) Applicant: OTICON A/S, Smørum (DK)

(72) Inventors: Rune Sø, Smørum (DK); Jens Troelsen, Smørum (DK)

(73) Assignee: Oticon A/S, Smørum (DK)

( * ) Notice: Subject to any disclaimer, the term of this patent is extended or adjusted under 35 U.S.C. 154(b) by 0 days. days.

This patent is subject to a terminal disclaimer.

(21) Appl. No.: 15/634,290

(22) Filed: Jun. 27, 2017

(65) Prior Publication Data

US 2017/0303055 A1 Oct. 19, 2017

Related U.S. Application Data

(62) Division of application No. 14/979,229, filed on Dec. 22, 2015, now Pat. No. 9,722,306.

(30) Foreign Application Priority Data

Dec. 22, 2014 (EP) ..... 14199715

(51) Int. Cl.

| | |
|---|---|
| ***H04R 25/00*** | (2006.01) |
| ***H01Q 1/27*** | (2006.01) |
| ***H01Q 1/48*** | (2006.01) |
| ***H01Q 1/24*** | (2006.01) |

(52) U.S. Cl.

CPC ..... *H04R 25/554* (2013.01); *H01Q 1/24* (2013.01); *H01Q 1/273* (2013.01); *H01Q 1/48* (2013.01); *H04R 2225/51* (2013.01)

(58) Field of Classification Search

CPC ..... H02Q 1/273; H04R 25/65; H04R 25/552; H04R 25/554; H04R 25/556; H04R 2225/51

USPC ..... 379/443; 381/312, 315, 322–324, 328, 381/330, 331; 455/90.3, 575.1, 575.7

See application file for complete search history.

(56) References Cited

U.S. PATENT DOCUMENTS

| | | | | |
|---|---|---|---|---|
| 8,565,457 | B2 * | 10/2013 | Polinske | H04R 25/554 381/312 |
| 8,779,991 | B2 * | 7/2014 | Ali | H01Q 1/243 343/702 |
| 2006/0109182 | A1 * | 5/2006 | Rosenberg | H01Q 1/243 343/702 |
| 2008/0287084 | A1 * | 11/2008 | Krebs | H01Q 1/243 455/271 |
| 2009/0231211 | A1 | 9/2009 | Zweers | |

FOREIGN PATENT DOCUMENTS

| | | | |
|---|---|---|---|
| EP | 1 646 109 | A1 | 4/2006 |
| EP | 2 284 948 | A1 | 2/2011 |
| EP | 2 458 674 | A2 | 5/2012 |
| EP | 2 458 674 | A3 | 5/2012 |
| EP | 2 680 366 | A1 | 1/2014 |
| WO | WO 2005/081583 | A1 | 9/2005 |

* cited by examiner

*Primary Examiner* — Brian Ensey
(74) *Attorney, Agent, or Firm* — Birch, Stewart, Kolasch & Birch, LLP

(57) ABSTRACT

An antenna unit is disclosed. A hearing device, such as a hearing aid, having an antenna device is disclosed. The antenna unit allows wireless communication to and from the hearing device.

20 Claims, 2 Drawing Sheets

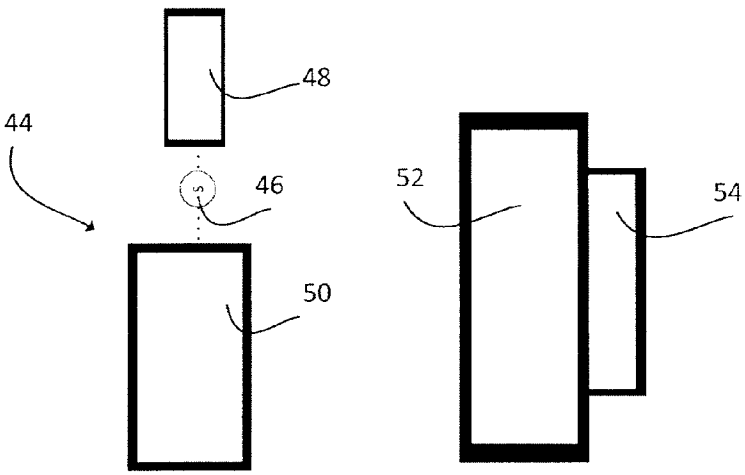
Fig. 7
Fig. 8
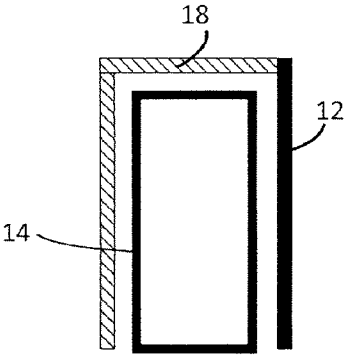
Fig. 9
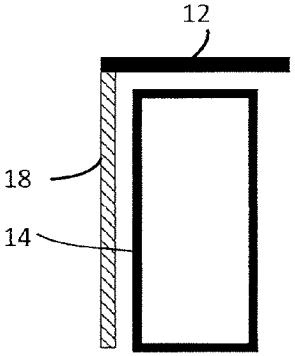
Fig. 10
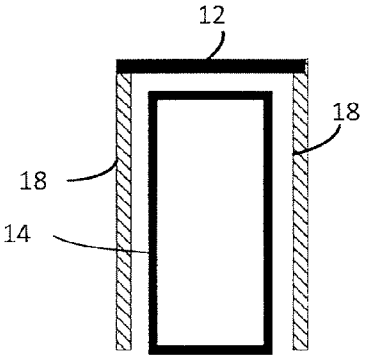
Fig. 11

ANTENNA UNIT

CROSS REFERENCE

This application is a Divisional of copending application Ser. No. 14/979,229, filed on Dec. 22, 2015, which claims priority under 35 U.S.C. § 119(a) to Application No. 14199715.5, filed in the European Patent Office on Dec. 22, 2014, all of which are hereby expressly incorporated by reference into the present application.

FIELD

The present disclosure is concerned with antenna units. The present disclosure is further concerned with antenna units in hearing devices, such as hearing aids or hearing instruments. The present disclosure is still further concerned with use of antenna units in a hearing device.

BACKGROUND

Devices placed at the ear for e.g. assisting a person having a hearing loss, or for any other reason providing an enhanced listening experience, may advantageously receive and/or transmit signals from/to other units wirelessly. For establishing wireless communication, an antenna is needed.

SUMMARY

It is contemplated that the antenna unit described herein may facilitate improved wireless communication to and from a head-worn device. Further, the present disclosure may provide an alternative solution compared to prior art.

In one aspect an antenna unit for use in a housing to be worn at an ear of a person may be embodied with one or more of the below mentioned features. The antenna unit may comprise a radiating antenna structure and a structure forming a ground for the radiating antenna structure, wherein an extended ground plane is arranged at a distance from the radiating antenna structure. The antenna unit may further comprise a communication unit connected with the radiating antenna structure for reception and/or transmission of data over a wireless link to an external unit via the radiating antenna structure.

In a further aspect, a hearing device may include an antenna unit arranged in a housing configured to be worn at an ear of a person. The housing may comprising a top part and respective left and right sides. The housing is preferably enclosing a number of electronic components, including an antenna unit. The antenna unit may comprise a radiating antenna structure and a structure forming a ground for the radiating antenna structure. An additional element may form an extended ground plane arranged at a distance from the radiating antenna structure and the extended ground plane may be electrically connected to the structure forming the ground. Further, a communication unit may be connected with the radiating antenna structure for reception and/or transmission of data over a wireless link to an external unit via the radiating antenna structure.

The antenna unit may be used for establishing wireless communication with an external device, such as a mobile phone, TV/TV-box, remote microphone, programming unit, remote control or the like, or to another device placed at the other ear of the person using a device including the antenna unit. This may enable transfer, e.g. streaming, of digitized sound and/or control signals to and from a wearable unit incorporating such an antenna unit.

The antenna unit may be adapted to emit and/or receive electromagnetic signals at radio frequencies. Radio frequencies may be in the range from 50 MHz to 10 GHz, such as 150 MHz to 750 MHz, such as 1 to 6 GHz, such as at 2.4 GHz, such as at 5.5 GHz. The antenna unit may be used at a single primary operational frequency or frequency range, or with multiple frequencies or frequency intervals.

Antennas for transmission of RF electromagnetic signals are preferably designed to have an electrical size of at least one quarter of the wavelength of the transmitted signal, since this generally allows high antenna efficiency and wide bandwidth. However, many apparatuses do not have room for an antenna large enough to satisfy this condition. For an RF signal with a frequency of e.g. 100 MHz, one quarter of the wavelength equals 0.75 m. It is thus common to utilize antennas that are physically considerably smaller than one quarter of the wavelength. Such antennas are generally referred to as "electrically short" or "electrically small" antennas. The antenna units described herein are preferably such electrically short antennas.

Generally, an improved communication link quality lower the power consumption of both the transmitter and receiver for a given link performance. The antenna unit according to the present disclosure may be used for wireless hearing devices in which information is wirelessly communicated between two hearing devices or between a wireless accessory device and a hearing device. Portable, and especially wearable, units usually have limited operation time limited by the amount of power available from physically small batteries, and thus lowering power consumption to extend battery life is a major issue for such devices. This is especially true for hearing devices, where the main focus of power consumption is improving the hearing situation for a user, such as a hearing impaired person.

One aspect of the present disclosure presents an antenna unit to be used in a hearing device. Such a hearing device is preferably a hearing aid that is adapted to improve or augment the hearing capability of a user by receiving an acoustic signal from a user's surroundings, generating a corresponding audio signal, possibly modifying the audio signal and providing the possibly modified audio signal as an audible signal to at least one of the user's ears. The "hearing device" may further refer to a device such as an earphone or a headset adapted to receive an audio signal electronically, possibly modifying the audio signal and providing the possibly modified audio signals as an audible signal to at least one of the user's ears. Such audible signals may be provided in the form of an acoustic signal radiated into the user's outer ear, or an acoustic signal transferred as mechanical vibrations to the user's inner ears through bone structure of the user's head and/or through parts of middle ear of the user or electric signals transferred directly or indirectly to cochlear nerve and/or to auditory cortex of the user.

The antenna unit of the present disclosure further provide improved stability in the sense of performance of the antenna unit under unpredictable environmental conditions, especially variation of ear physiology/morphology, the use of glasses or not and variations in placement of the housing on/at the ear of the wearer. This is at least partly seen in a more constant matching of the antenna, further the efficiency is improved relative to other types of antenna used in relation to other at-ear-worn devices.

BRIEF DESCRIPTION OF DRAWINGS

The aspects of the disclosure may be best understood from the following detailed description taken in conjunction with the accompanying figures. The figures are schematic and simplified for clarity, and they just show details to improve the understanding of the claims, while other details are left out. Throughout, the same reference numerals are used for identical or corresponding parts. The individual features of each aspect may each be combined with any or all features of the other aspects. These and other aspects, features and/or technical effect will be apparent from and elucidated with reference to the illustrations described hereinafter in which:

FIG. 7 is a schematic view of an antenna unit having a radiating structure and a ground plane, FIG. 8 is a schematic view of a ground plane and an extended ground plane, FIGS. 9-11 are schematic views of an antenna unit and a battery.

DETAILED DESCRIPTION

Figure 1:
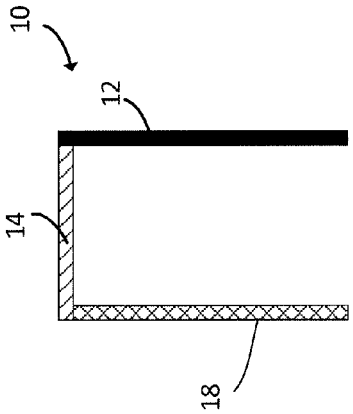
FIG. 1 is a schematic illustration of an antenna structure.

The detailed description set forth below in connection with the appended drawings is intended as a description of various configurations. The detailed description includes specific details for the purpose of providing a thorough understanding of various concepts. However, it will be apparent to those skilled in the art that these concepts may be practiced without these specific details. Several aspects of the apparatus and methods are described by various blocks, functional units, modules, components, circuits, steps, processes, algorithms, etc. (collectively referred to as "elements"). Depending upon particular application, design constraints or other reasons, these elements may be implemented using electronic hardware, computer program, or any combination thereof.

A hearing device may include a hearing aid that is adapted to improve or augment the hearing capability of a user by receiving an acoustic signal from a user's surroundings, generating a corresponding audio signal, possibly modifying the audio signal and providing the possibly modified audio signal as an audible signal to at least one of the user's ears. The "hearing device" may further refer to a device such as an earphone or a headset adapted to receive an audio signal electronically, possibly modifying the audio signal and providing the possibly modified audio signals as an audible signal to at least one of the user's ears. Such audible signals may be provided in the form of an acoustic signal radiated into the user's outer ear, or an acoustic signal transferred as mechanical vibrations to the user's inner ears through bone structure of the user's head and/or through parts of middle ear of the user or electric signals transferred directly or indirectly to cochlear nerve and/or to auditory cortex of the user.

The hearing device may be adapted to be worn in any known way. This may include i) arranging a unit of the hearing device behind the ear with a tube leading air-borne acoustic signals into the ear canal or with a receiver/loudspeaker arranged close to or in the ear canal such as in a Behind-the-Ear type hearing aid, and/or ii) arranging the hearing device entirely or partly in the pinna and/or in the ear canal of the user such as in a In-the-Ear type hearing aid or In-the-Canal/Completely-in-Canal type hearing aid, or iii) arranging a unit of the hearing device attached to a fixture implanted into the skull bone such as in Bone Anchored Hearing Aid or Cochlear Implant, or iv) arranging a unit of the hearing device as an entirely or partly implanted unit such as in Bone Anchored Hearing Aid or Cochlear Implant. However, it is contemplated that the antenna unit is best suited for use in a Behind-The-Ear-type hearing device.

A "hearing system" refers to a system comprising one or two hearing devices, and a "binaural hearing system" refers to a system comprising two hearing devices where the devices are adapted to cooperatively provide audible signals to both of the user's ears. The hearing system or binaural hearing system may further include auxiliary device(s) that communicates with at least one hearing device, the auxiliary device affecting the operation of the hearing devices and/or benefitting from the functioning of the hearing devices. A wired or wireless communication link between the at least one hearing device and the auxiliary device is established that allows for exchanging information (e.g. control and status signals, possibly audio signals) between the at least one hearing device and the auxiliary device. Such auxiliary devices may include at least one of remote controls, remote microphones, audio gateway devices, mobile phones, public-address systems, car audio systems or music players or a combination thereof. The audio gateway is adapted to receive a multitude of audio signals such as from an entertainment device like a TV or a music player, a telephone apparatus like a mobile telephone or a computer, a PC. The audio gateway is further adapted to select and/or combine an appropriate one of the received audio signals (or combination of signals) for transmission to the at least one hearing device. The remote control is adapted to control functionality and operation of the at least one hearing devices. The function of the remote control may be implemented in a SmartPhone or other electronic device, the SmartPhone/electronic device possibly running an application that controls functionality of the at least one hearing device.

In general, a hearing device includes i) an input unit such as a microphone for receiving an acoustic signal from a user's surroundings and providing a corresponding input audio signal, and/or ii) a receiving unit for electronically receiving an input audio signal. The hearing device further includes a signal processing unit for processing the input audio signal and an output unit for providing an audible signal to the user in dependence on the processed audio signal.

The input unit may include multiple input microphones, e.g. for providing direction-dependent audio signal processing. Such directional microphone system is adapted to enhance a target acoustic source among a multitude of acoustic sources in the user's environment. In one aspect, the directional system is adapted to detect (such as adaptively detect) from which direction a particular part of the microphone signal originates. This may be achieved by using conventionally known methods. The signal processing unit may include amplifier that is adapted to apply a frequency dependent gain to the input audio signal. The signal processing unit may further be adapted to provide other relevant functionality such as compression, noise reduction, etc. The output unit may include an output transducer such as a loudspeaker/receiver for providing an air-borne acoustic signal transcutaneously or percutaneously to the skull bone or a vibrator for providing a structure-borne or liquid-borne acoustic signal. In some hearing devices, the output unit may include one or more output electrodes for providing the electric signals such as in a Cochlear Implant.

In the following the terms dipole and monopole are used in a descriptive manner to illustrate which basic, theoretic, antenna structure the actual antenna unit resembles.

Figure 5:
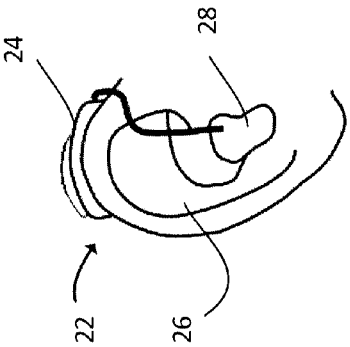
FIG. 5 is a schematic illustration of a hearing device positioned behind an ear of a user.

FIG. 1 schematically illustrates a cross-sectional view of an antenna unit 10 for use in a housing to be worn at an ear of a person, such as illustrated in FIG. 5. The antenna unit 10 comprises a radiating antenna structure 12 and a structure forming a ground 14 for the radiating antenna structure 12, and further an extended ground plane 18 arranged at a distance from the radiating antenna structure 12. Furthermore, when used in a hearing device, a communication unit is electrically connected with the radiating antenna structure 12 for reception and/or transmission of data over a wireless link to an external unit via the antenna unit 10. Via the antenna unit 10, the communication unit may establish wireless communication with an external device, such as a mobile phone, TV, remote control, remote microphone or the like, or to less remotely placed units such as to a wearable device placed at an ear on the opposite side of the head of the person.

Generally, the extended ground plane may be formed at least partly by a metallic structure at the antenna structure, such as a metallic sheet, a substrate carrying a metallic coating or layer, a flex print, or at least partly by a coating on an external housing part of a hearing device. The extended ground plane may be formed by a combination of elements.

Figure 2:
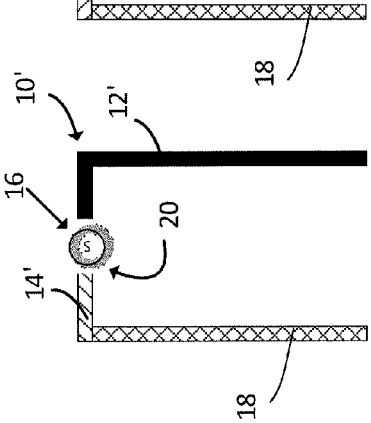
FIGS. 2-4 are schematic illustrations of antenna structures.
Figure 3:
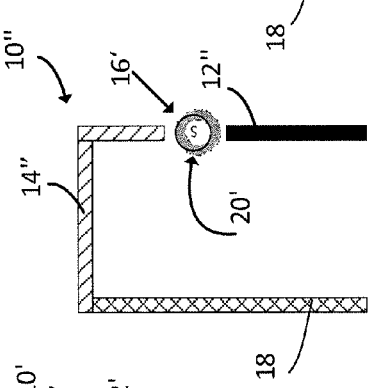
Figure 4:
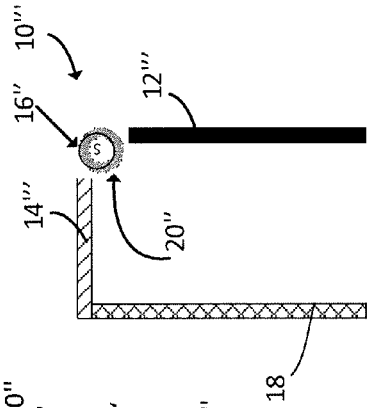

FIGS. 2, 3 and 4 schematically illustrates cross-sectional views of antenna units 10', 10" and 10'". In FIG. 2 a gap 16 is provided. In FIG. 2 the gap 16 is arranged at the top of the antenna unit 10'. A feed 20 is arranged in the gap 16.

In FIG. 3 the gap 16' is arranged at a side of the antenna unit 10". A feed 20' is arranged at the gap 16'.

In FIG. 4 the gap 16" is arranged at a corner or joint line between two plates 14'" and 12'" making up the radiating structure, where the two plates 14'" and 12'" are arranged so that they have an angle between them around 90 degrees. A feed 20" is arranged in the gap 16".

Generally, the feed is provided to excite the antenna structure to radiate. The feed is connected to a transmitter unit to transmit an intended signal.

FIG. 5 schematically illustrates a hearing device 22 having two parts, a behind-the-ear-part 24 placed at the top of the pinna 26 of the user, and an in-the-ear-part 28 positioned partly in the ear canal of the user.

Figure 6:
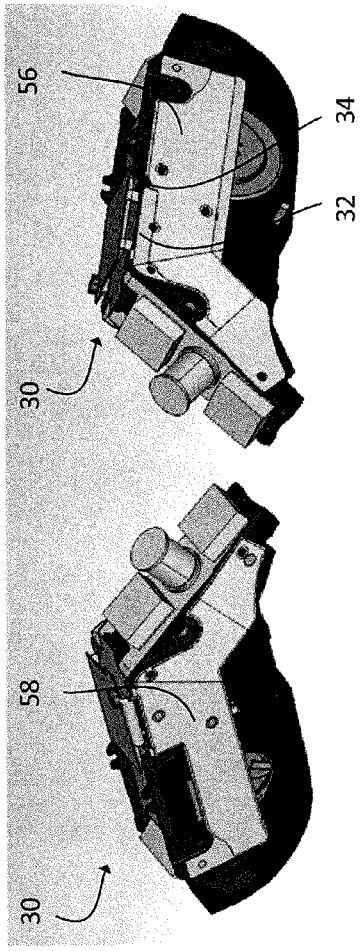
FIG. 6 is a schematic illustration of a hearing device configured to be positioned behind an ear of a user, where the outer housing is removed.

FIG. 6 schematically illustrates two sides of an antenna unit 30. As illustrated in the right-hand side of the figure, the antenna unit 30 comprises a two-armed monopole 56 on the left-hand side of the instrument, and as illustrated in the left-hand side of the figure, an extended ground plane 58 is located on the right-hand side of the instrument. A housing configured to be in contact with the pinna of a user, not illustrated. At the gap 32, a feed 34 is present. The feed 34 is electrically connected to a signal generator generating a feed signal to be transformed into the intended radiated electromagnetic signal. Any suitable type of coding scheme may be used for transferring data to and from the hearing device.

It has been seen that adding the extended ground plane to especially the side of the instrument not having the active radiating part, i.e. the side opposite the two-armed monopole in this case, improves stability of operation. This is seen by the hearing device incorporating such an antenna unit performs substantially the same in different conditions such as non-optimal positioning of the housing, e.g. due to ears not being shaped as average ears, or e.g. the housing being tilted differently than prior. These misalignments give rise to different loading conditions for the antenna unit, which alter the performance of the antenna unit if not compensated for.

FIG. 7 schematically illustrates a dipole-like structure 44, which is electrically equivalent to the structures illustrated herein. A feed 46 is connected between two parts, a first, smaller, part 48 and a second, larger part 50. The second part is here considered the ground plane for the radiant structure.

FIG. 8 schematically illustrates a ground 52 and a partly connected extended ground 54. The ground 52 may be established using the battery in a hearing device, and the extended ground may be established using a different structure placed inside the housing of the hearing device. FIG. 9 is a schematic illustration of an antenna unit 10 surrounding a battery forming a ground 14. A radiating antenna structure 12 is positioned at the right-hand side and an extended ground plane 18 is formed at the top of the antenna unit and at the left-hand side. FIG. 10 is an antenna structure having a radiating antenna structure 12 at the top of the antenna unit and a battery forming a ground 14 for the antenna unit 10, further, an extended ground 18 is positioned at the left-hand side of the antenna unit. Alternatively the extended ground could be positioned at the right-hand side. FIG. 11 is an antenna structure having a radiating antenna structure 12 at the top of the antenna unit and a battery forming a ground 14 for the antenna unit 10, further, an extended ground 18 is positioned at both the left-hand side of the antenna unit and the right-hand side. The left- and right-hand extended ground are electrically connected.

In relation to the antenna structures disclosed herein, it has been seen that the combination of the ground 14 for the radiating antenna structure 12 and the extended ground plane 18 enhance the performance of the antenna unit 10 when the antennas are loaded with the presence of a head. This manifests itself by the antenna is less susceptible to changes or misalignments compared to an expected orientation relative to a body part, e.g. an ear. Also, other factors, such as the user wearing glasses, have been seen not to influence the performance of the antenna unit.

The performance of antennas are often measured relative to a well-know reference, e.g. a standardized human body. The actual placement of the housing on a real person's ear will represent a unique environment and consequently a less unpredictable radiation pattern and further consequently a less predictable performance of the antenna unit 10. The extended ground plane 18 thus make the performance of the antenna unit 10 more robust and allows the antenna unit 10 to perform better under more conditions.

The antenna unit as disclosed herein is used to, among other things, enable transfer, e.g. streaming, of digitized sound and/or control signals to and from a wearable unit incorporating such an antenna unit 10.

A processor connected to the communication unit then carry out data processing. The communication unit handles the data traffic via the antenna unit to/from an external device, but may also handle communication to/from a processor in the system e.g. a sound processor or the like.

The antenna unit 10 is here used in a wearable device having a housing to be worn at an ear of a person. This puts some constraints on size and shape, and consequently on the performance, of an antenna unit 10 in such a housing. Many antennas have an optimal performance when an electrical length of the antenna approaches at least ¼ of a wavelength. As an example, at 2.4 GHz, which one of the frequencies for the Bluetooth and the Bluetooth Low Energy protocol, the ¼ wavelength would be 3,125 cm in free space, which would be unpractical when the housing is to be placed on, at or in the ear. By providing not only a ground plane 14 to the radiating antenna structure 12, but an extended, ground plane 18, enables the antenna unit 10 to perform better compared to other antenna structures for similar purposes. As for the ground plane 14, it could be advantageous to use the battery, as this is one of the largest conductive structures in e.g. a hearing device. As for the extended ground plane 18, a relatively large metallic, conductive, structure, e.g. a slab or plate of electrically conductive material, may be used.

Unlike a parasitic element, an extended ground plane is fully, or at least widely, connected to the ground plane. Further, an extended ground plane is small measured in wavelength, which means that the extended ground plane is preferably less than one quarter of the operational wavelength of the antenna unit, whereas the electrical length of a parasitic element is comparable to, or larger than, the electrical length of the antenna, i.e. the radiating structure. The extended ground plane is preferably in the range 25 to 5 percent of the operational wavelength, such as below 25 percent, such as in the range 20 to 10 percent.

The radiating antenna structure 12 may be arranged in the housing in a number of orientations, including one where when the antenna unit is worn by the person, also referred to as the user, so that the electrical field component of the radiated field is substantially parallel to an ear-to-ear axis of the user. With this configuration, when the housing is worn by the user the electromagnetic field emitted by the antenna propagates along a surface of a head of the user with its electrical field substantially orthogonal to the surface of the head of the user along its path to the opposite ear. Having the electrical field component of the radiated field orientated perpendicular to surface of the head provides an enhanced performance when the target is to transfer a signal from one ear to the other, as this reduces the conductive loss in the pathway from one ear to the other as the signal travels along the skin surface of the head. When talking of the electrical field component, it may be considered as the predominant field component as the radiated field in practice may comprise several orientations, but one direction may be dominant, and it is this direction that is in the present context is referred to. In other instances, the electrical field component may be directed substantially perpendicular to the ear-to-ear axis, this could be advantageous when the target for the communication is an external device, e.g. placed in front of the user, as would most often be the case when communicating with e.g. a TV or mobile phone.

The radiating antenna structure may be a monopole antenna, a dipole antenna or a combination thereof. Furthermore, the antenna structure may be formed as a multiple-arm monopole antenna, a two-arm monopole antenna, a three-arm monopole antenna, a multiple-arm, a folded monopole antenna, a slot antenna, a patch antenna, a loop antenna, a flex antenna, a ceramic chip antenna, an injection-molded thermoplastic part with integrated electronic circuit traces, a printed antenna or any combinations thereof.

The geometry and technology for implementing the radiating antenna structure may be chosen in dependence of the intended use and/or space considerations. In some cases two or more radiating antenna geometries, configured to operate at different frequencies, may be combined to provide two different kinds of radiation patterns, e.g. one for communication to a device placed at the opposite side of the head, and another for communicating from the ear-placed device to a device held in the hand of the user. The radiating antenna structure may be formed as a structure on a flex print or as a string of material, e.g. coiled up around a battery in a number of windings, either complete or partial. Other suitable forms may be used as well. Further, if a string of material is used, the end of the string may be attached to some element in the housing, or the end may simply hang free. The string may have a substantially circular cross-section, be flat or have any other suitable cross-section.

The extended ground plane may extend in a plane substantially orthogonal to the radiating antenna structure or wherein the extended ground plane extends in a plane substantially parallel to the radiating antenna structure. Seen from one end, the three parts making up the major part of the antenna unit could be arranged U-shaped, but preferably with a flat bottom, where the two parallel sides are the radiating antenna structure and the ground plane extension, and the part interconnecting the two is the ground plane. In case a battery is used as ground plane, the two other parts, the radiating antenna structure and the ground plane extension could be placed at opposite sides, such as top-bottom of a 312 battery.

In order to further optimize space consumption in a housing to be worn at an ear of a person, the radiating antenna structure may include an opening configured to receive a battery and/or an audio converter and/or an input device. The input device may for instance a push-button or other mechanical input device.

The antenna unit as disclosed above may be used in a hearing device comprising an audio converter for reception of an acoustic signal and conversion of the received acoustic signal into a corresponding electrical audio signal, a signal processor for processing the electrical audio signal into a processed audio signal so as to compensate a hearing loss of a user of the hearing device, a transducer connected to an output of the signal processor for converting the processed audio signal into an output signal, and a transceiver for wireless data communication , wherein the transceiver is connected to the antenna unit adapted for electromagnetic field emission and/or electromagnetic field reception.

The figures are schematic and simplified for clarity, and they just show details to improve the understanding of the claims, while other details are left out. Throughout, the same reference numerals are used for identical or corresponding parts.

It is intended that the structural features of the devices described above, either in the detailed description and/or in the claims, may be combined with steps of the method, when appropriately substituted by a corresponding process.

As used, the singular forms "a," "an," and "the" are intended to include the plural forms as well (i.e. to have the meaning "at least one"), unless expressly stated otherwise. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will also be understood that when an element is referred to as being "connected" or "coupled" to another element, it can be directly connected or coupled to the other element but an intervening elements may also be present, unless expressly stated otherwise. Furthermore, "connected" or "coupled" as used herein may include wirelessly connected or coupled. As used herein, the term "and/or" includes any and all combinations of one or more of the associated listed items. The steps of any disclosed method is not limited to the exact order stated herein, unless expressly stated otherwise.

It should be appreciated that reference throughout this specification to "one embodiment" or "an embodiment" or "an aspect" or features included as "may" means that a particular feature, structure or characteristic described in connection with the embodiment is included in at least one embodiment of the disclosure. Furthermore, the particular features, structures or characteristics may be combined as suitable in one or more embodiments of the disclosure. The previous description is provided to enable any person skilled in the art to practice the various aspects described herein. Various modifications to these aspects will be readily apparent to those skilled in the art, and the generic principles defined herein may be applied to other aspects.

The claims are not intended to be limited to the aspects shown herein, but is to be accorded the full scope consistent with the language of the claims, wherein reference to an element in the singular is not intended to mean "one and only one" unless specifically so stated, but rather "one or more." Unless specifically stated otherwise, the term "some" refers to one or more.

Accordingly, the scope should be judged in terms of the claims that follow.

In the description of the figures, the following reference numerals was used:

10 Antenna unit
12 Radiating antenna structure
14 Ground
16 Gap
18 Extended ground plane
20 Feed
22 Hearing device
24 behind-the-ear part
26 Pinna
28 in-the-ear part
30 Antenna unit
32 gap
34 feed
44 Dipole-like structure
46 Feed
48 First part
50 Second part
52 Ground
54 Extended ground
56 two-armed monopole
58 Extended ground plane

The invention claimed is:

1. A hearing aid device comprising:

a housing configured to be worn at an ear of a person, the housing comprising a top part and respective first and second sides;

an antenna unit arranged in the housing, the antenna unit comprising:

a radiating antenna structure;

a structure forming a ground for the radiating antenna structure;

a feed arranged between the radiating antenna structure and the structure forming the ground; and an additional element that forms an extended ground plane, the additional element being arranged at a distance from the radiating antenna structure, the additional element comprising a first part arranged at the first side of the housing and a second part arranged at the second side of the housing, the extended ground plane being electrically and directly connected to the structure forming the ground; and a communication unit connected with the radiating antenna structure for reception and/or transmission of data over a wireless link to an external unit via the radiating antenna structure.

2. The hearing aid device according to claim 1, wherein the radiating antenna structure is positioned nearer the housing than the structure forming the ground.

3. A hearing aid device comprising:

an antenna unit arranged in a housing, the antenna unit comprising:

a radiating antenna structure;

a structure forming a ground for the radiating antenna structure;

a feed arranged between the radiating antenna structure and the structure forming the ground; and an additional element that forms an extended ground plane, wherein the extended ground plane comprises a first part arranged at a top side of the housing and a second part arranged at either a first side or second side of the housing.

4. The hearing aid device according to claim 3, wherein the radiating antenna structure is arranged at the top side and/or a left and/or right side of the housing.

5. The hearing aid device according claim 1, wherein the structure forming the ground includes a battery.

6. The hearing aid device according to claim 1, wherein the radiating antenna structure is arranged so that when the housing including the antenna unit is worn by the person the electrical field component of the radiated field is substantially parallel to an ear-to-ear axis of the person.

7. The hearing aid device according to claim 1, wherein the radiating antenna structure includes a slot antenna, a multiple-arm monopole antenna, a two-arm monopole antenna, a three-arm monopole antenna, a multiple-arm, a folded monopole antenna, a patch antenna, a loop antenna, a flex antenna, a ceramic chip antenna, an injection-molded thermoplastic part with integrated electronic circuit traces, a printed antenna or any combinations thereof.

8. The hearing aid device according to claim 1, wherein the extended ground plane has an extension less than one quarter of the operational wavelength of the antenna unit, such as 25 percent to 5 percent of the operational wavelength.

9. The hearing aid device according to claim 1, wherein the extended ground plane is formed at least partly by a metallic structure, at least partly by a coating on an external housing part of a hearing device, a flex print, a substrate carrying a metallic layer or any combination thereof.

10. The hearing aid device according to claim 1, comprising: an input transducer, a signal processor and an output transducer, the signal processor being configured to process sound from the input transducer so as to compensate from the hearing loss of the user, the output transducer configured to output the processed signal from the signal processor.

11. A system comprising a hearing aid device according to claim 1 and a portable unit configured to communicate with the hearing aid device.

12. The system according to claim 11, wherein the portable unit is a mobile phone.

13. The system according to claim 11, wherein the hearing device and the portable device are configured to stream sound between them via the antenna device using a data protocol.

14. The hearing aid device according claim 3, wherein the structure forming the ground includes a battery.

15. The hearing aid device according to claim 3, wherein the radiating antenna structure is arranged so that when the housing including the antenna unit is worn by a person the electrical field component of the radiated field is substantially parallel to an ear-to-ear axis of the person.

16. The hearing aid device according to claim 3, wherein the radiating antenna structure includes a slot antenna, a multiple-arm monopole antenna, a two-arm monopole antenna, a three-arm monopole antenna, a multiple-arm, a folded monopole antenna, a patch antenna, a loop antenna, a flex antenna, a ceramic chip antenna, an injection-molded thermoplastic part with integrated electronic circuit traces, a printed antenna or any combinations thereof.

17. The hearing aid device according to claim 3, wherein the extended ground plane has an extension less than one quarter of the operational wavelength of the antenna unit.

18. The hearing aid device according to claim 3, wherein the extended ground plane is formed at least partly by a metallic structure, at least partly by a coating on an external housing part of a hearing device, a flex print, a substrate carrying a metallic layer or any combination thereof.

19. The hearing aid device according to claim 3, comprising: an input transducer, a signal processor and an output transducer, the signal processor being configured to process sound from the input transducer so as to compensate from the hearing loss of the user, the output transducer configured to output the processed signal from the signal processor.

20. A system comprising a hearing aid device according to claim 3 and a portable unit configured to communicate with the hearing aid device.

* * * * *